US010499748B2

(12) United States Patent
Xu

(10) Patent No.: US 10,499,748 B2
(45) Date of Patent: Dec. 10, 2019

(54) BABY DINING CHAIR

(71) Applicant: Jiahong Xu, Dongguan Guangdong (CN)

(72) Inventor: Jiahong Xu, Dongguan Guangdong (CN)

(73) Assignee: DONGGUAN MASTER KIDS TOY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/959,300

(22) Filed: Apr. 23, 2018

(65) Prior Publication Data

US 2019/0320813 A1 Oct. 24, 2019

(51) Int. Cl.
*A47D 1/00* (2006.01)

(52) U.S. Cl.
CPC ..... *A47D 1/0081* (2017.05); *A47D 1/004* (2013.01)

(58) Field of Classification Search
CPC ..... A47D 1/008; A47D 1/0081; A47D 1/004
See application file for complete search history.

(56) References Cited

U.S. PATENT DOCUMENTS 4,303,272 A * 12/1981 Berggren ..... A47D 1/008 297/153
4,844,537 A * 7/1989 Reed ..... A47D 1/004 297/174 R
7,905,549 B2 * 3/2011 Lake ..... A47D 1/008 297/153
8,157,327 B2 * 4/2012 Tomasi ..... A47D 1/002 297/148
8,177,297 B2 * 5/2012 Powell ..... A47D 1/008 297/148
8,297,694 B2 * 10/2012 Arnold, IV ..... A47D 1/008 297/174 CS
8,668,273 B2 * 3/2014 Wang ..... A47D 1/002 297/173
8,789,882 B2 * 7/2014 Bergkvist ..... A47D 1/02 297/154
9,192,246 B2 * 11/2015 Chen ..... A47C 7/70
9,844,278 B2 * 12/2017 Winterhalter ..... A47D 1/02
2004/0026976 A1 * 2/2004 Chen ..... A47D 1/002 297/344.14
2008/0179921 A1 * 7/2008 Lake ..... A47D 1/008 297/16.2
2009/0146466 A1 * 6/2009 Lan ..... A47D 1/008 297/48

* cited by examiner

*Primary Examiner* — Philip F Gabler

(57) ABSTRACT

An baby dining chair comprises a seat bucket, an armrest, and a seat bucket support mechanism, and a first pivotal portion and a second pivotal portion are set on the two sides of the seat bucket; the dining table includes a table top and table connecting arms, wherein the table connecting arm includes a table connecting upper arm and a table connecting lower arm pivotally connected with each other, and a connecting arm rotation and control mechanism. The improved baby dining chair, not only can the seat angle be adjusted, but also the dining table, during the seat angle adjustment, can be adjusted adaptively in accordance with the adjustment of seat angle, so that the dining table connecting lower arm will always be kept in a horizontal state to ensure that the dining table will not tilt at a certain angle.

10 Claims, 10 Drawing Sheets

BABY DINING CHAIR

BACKGROUND OF INVENTION

1. Field of the Invention

The present invention relates generally to a technical field of dining chair products, and more particularly to a baby dining chair.

2. Description of Related Art

Because the baby's sitting posture is unstable, it is not possible for them to sit on their own to eat in an ordinary dining chair. To this end, people designed baby dining chair for infants and young children use.

Ordinary baby dining chair comprises support legs, a seat, and a rotary dining table. When in use, the dining table is revolved to the front of the seat, and an annular space is formed between the dining table and the seat. So, when the baby sits in the seat, the dining table not only has the function of placing food utensils, but also constitutes restrictive protection for the baby.

Although the dining table has the function of protecting babies, there are certain restrictions in the use of dining table. Due to the difficulty in adjusting the seating angle of the current baby dining chair, it is generally only suitable for use when sitting over a meal, and cannot be adjusted to a comfortable angle to act as an ordinary rest chair. In view of this, inventors have proposed a baby dining chair with an adjustable seat angle, but there are still some deficiencies in the actual use of such a chair. Because there has been no associated adjustment structure between the angle adjustment of the seat and the horizontal movement of the dining table, this may lead to the following problems: while a user adjusts the angle of the seat, the dining table does not make a synchronous adjustment with the rotation of the seat; this may cause the dining table to no longer keep in a horizontal state and to tilt at a certain angle. If, in this time, items such as food are placed on the top of the dining table, overturning may occur. Therefore, the inventor put forward the following technical scheme for this problem.

SUMMARY OF THE INVENTION

The technical problem to be solved by the present invention is to overcome the deficiency of the prior art and provide an improved baby dining chair.

In order to solve the above technical problems, the present invention adopts the following technical solutions:

An baby dining chair comprising: a base (1), a supporting leg (2), a seat (3) and a dining table (4), wherein the supporting leg (2) is installed between the base (1) and the seat (3); the dining table (4) is pivotally connected to the seat (3);

wherein the seat (3) includes a seat bucket (31) for the baby to sit, armrests (32) disposed on both sides of the seat bucket (31), and a seat bucket support mechanism (33) located below the seat bucket (31); a first pivotal portion (311) and a second pivotal portion (312) are set on both sides of the seat bucket (31);

wherein the dining table (4) includes a table top (41) and a table connecting arm (42); the table connecting arm (42) includes a table connecting upper arm (421) and a table connecting lower arm (422) pivotally connected with each other; a connecting arm rotation and control mechanism is set at a pivotal portion of the table connecting upper arm (421) and the table connecting lower arm (422);

one end of the table connecting upper arm (421) is pivotally connected to the first pivotal portion (311); a lower end of the armrest (32) and an upper end of the seat bucket support mechanism (33) are both pivotally connected to the second pivotal portion (312); an upper end of the armrest (32) is pivotally connected to one end of the table connecting lower arm (422);

wherein the second pivotal portion (312) is further provided with a rotation brake mechanism, through which the seat bucket (31) rotates around the second pivotal portion (312).

More particularly, wherein the armrest (32) is formed with an armrest pivotal portion (320) at a place corresponding to the second pivotal portion (312), and the seat bucket support (33) is formed with a support pivotal portion (3310) at a place corresponding to the second pivotal portion (312);

the rotation brake mechanism comprises a seat bucket spline (3120) formed in the second pivotal portion (312), a key cap (6) set on the armrest pivotal portion (320), a brake gear (7) located between the support member pivotal portion (3310) and the armrest pivotal portion (320), a spring (8) located between the brake gear (7) and the support member pivotal portion (3310);

a support spline (3311) is formed on the inner wall of the support member pivotal portion (3310) to mesh with the brake gear (7), and the brake gear (7) falls into both the support spline (3311) and the seat bucket spline (3120); through pressing the key cap (6), a force is generated to overcome the spring (8) pressure to push the brake gear (7) to move inward, making the brake gear (7) fall into the seat bucket spline (3120) and no longer interfering with the support spline (3311), thus fulfilling the unlock of the rotation brake mechanism.

More particularly, wherein the table connecting upper arm (421) has a upper arm pivotal portion (4211), and the table connecting lower arm (422) has a lower arm pivotal portion (4221);

the connecting arm rotation and control mechanism comprises an upper arm spline (4213) formed on the inside of the upper arm pivotal portion (4211), a connecting arm control button (423) set on the outside of the upper arm pivotal portion (4211), a connecting arm brake gear (424) and a connecting arm spring (425) located between the upper arm pivotal portion (4211) and the lower arm pivotal portion (4221), and a lower arm spline (4222) set on the outside of the lower arm pivotal portion (4221);

under the action of the connecting arm spring (425), the connecting arm brake gear (424) will fall into the upper arm spline (4213) and the lower arm spline (4222) at the same time; by pressing the connecting arm control button (423) to overcome the spring force generated by the connecting arm spring (425), the connecting arm brake gear (424) is pushed to fall into the lower arm spline (4222) to achieve the unlock of the connecting arm rotation and control mechanism.

More particularly, wherein the seat bucket support mechanism (33) comprises a seat bucket upper support member (331) and a seat bucket lower support member (332); the main body of the seat bucket upper support member (331) is in a U shape; the two ends of the seat bucket upper support member (331) are connected to the second pivotal portion (312); the upper end of the seat bucket lower support member (332) is connected to the middle position of the bottom of the seat bucket upper support member (331), and the lower end of the seat bucket lower support member (332) is pivotally connected with the supporting leg (2).

More particularly, wherein the lower end of the table connecting lower arm (422) is formed with an armrest receiving slot (4223); the front end of the armrest (32) is fallen into the armrest receiving slot (4223); the end of the armrest (32) is pivotally connected to the armrest receiving slot (4223) with a pin (4224).

More particularly, wherein the dining table (4) comprises a table top (41), table connecting arms (42), and a table moving and controlling assembly (43), wherein one end of the table connecting arms (42) is pivotally connected to the first pivotal portion (311) at the side of the seat (3), and the other end forms a sleeve engagement with the table top (41); the table moving and controlling assembly (43) is configured between the table connecting arm (42) and the table top (41); through the table moving and controlling assembly (43), table connecting arms (42) and table top (41) are locked.

More particularly, wherein the table moving and controlling assembly (43) comprises a movement control key (431), a movement linking bar (432), and a movement locking element (433); the movement linking bar (432) is a U-shaped bar; the front end of the movement linking bar (432) is linked with the movement control key (431), and the two terminals are linked with the movement locking element (433); the movement locking element 433 is locked with the table connecting arm (42); by triggering the movement control key (431), movement linking bar (432) is driven to drive the movement locking element (433) to unlock the table connecting arm (42).

More particularly, wherein the movement locking element (433) comprises a movement trigger (4331) connected to the end of the movement linking bar (432) and a movement buckle (4332) matched with the movement trigger (4331); the combination surface between the movement trigger (4331) and the movement buckle (4332) has an inclined surface, and the movement buckle (4332) is extended downwardly to form a locking pin (4333) that is used to lock the table connecting arm (42).

More particularly, wherein a plurality of locking pin insertion holes (420) are provided at positions corresponding to the locking pin (4333) on the table connecting arm (42); the locking pin (4333) is inserted into the locking pin insertion holes (420) provided on the table connecting arm (42) to achieve the locking of movement locking element (433) with the table connecting arm (42); by triggering the movement control key (431) to bring the movement linking bar (432) to drive the movement trigger (4331) and the movement buckle (4332) to move relative to each other, the combined inclined surface between said two elements can lift up the movement buckle (4332), making the locking pin (4333) separate from the locking pin insertion holes (420).

More particularly, wherein the supporting leg (2) adopts an independent, tilt-setting telescopic link structure, and the upper end of the supporting leg (2) is pivotally connected to the third pivotal portion (313) of the seat bucket (31) and the lower end is connected to the base (1).

Compared with the prior art, the present invention has the following effects:

1. In the present invention, not only can the seat angle be adjusted, but also the dining table, during the seat angle adjustment, can be adjusted adaptively in accordance with the adjustment of seat angle, so that the dining table connecting lower arm will always be kept in a horizontal state, or the dining table will be kept in a horizontal direction, ensuring that the dining table will not tilt at a certain angle.

2. The dining table of this case adopts a structure that can be adjusted horizontally. Based on a user's need, he can pull the table top of the dining table to fulfill horizontal movement and adjust the space between the dining table and the seat to meet the practical needs of babies in different sizes.

3. This case has a height-adjustable function. When lowered to the lowest position, the dining table can be used directly as a children's chair.

4. This case adopts a pivotal structure, and the entire dining chair can be folded, which facilitates storage and transportation.

To sum up, the present invention is simple in structure, and has a variety of functions and market competitiveness.

DETAILED DESCRIPTION OF THE INVENTION

Figure 1:
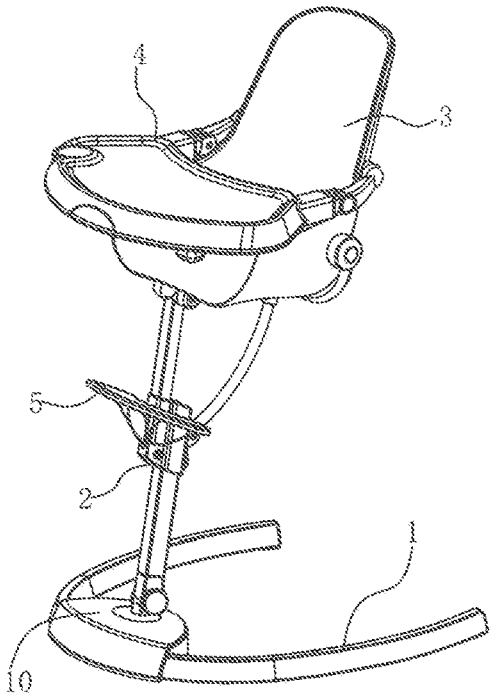
FIG. 1 is a perspective view of the present invention.
Figure 2:
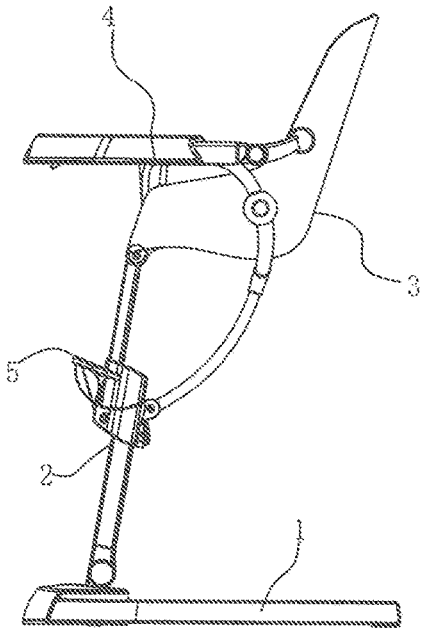
FIG. 2 is a right side view of the present invention.

As shown in FIG. 1 and FIG. 2, this case is an improved baby dining chair, comprising a base 1, a supporting leg 2, a seat 3, a dining table 4 and a pedal 5.

Figure 3:
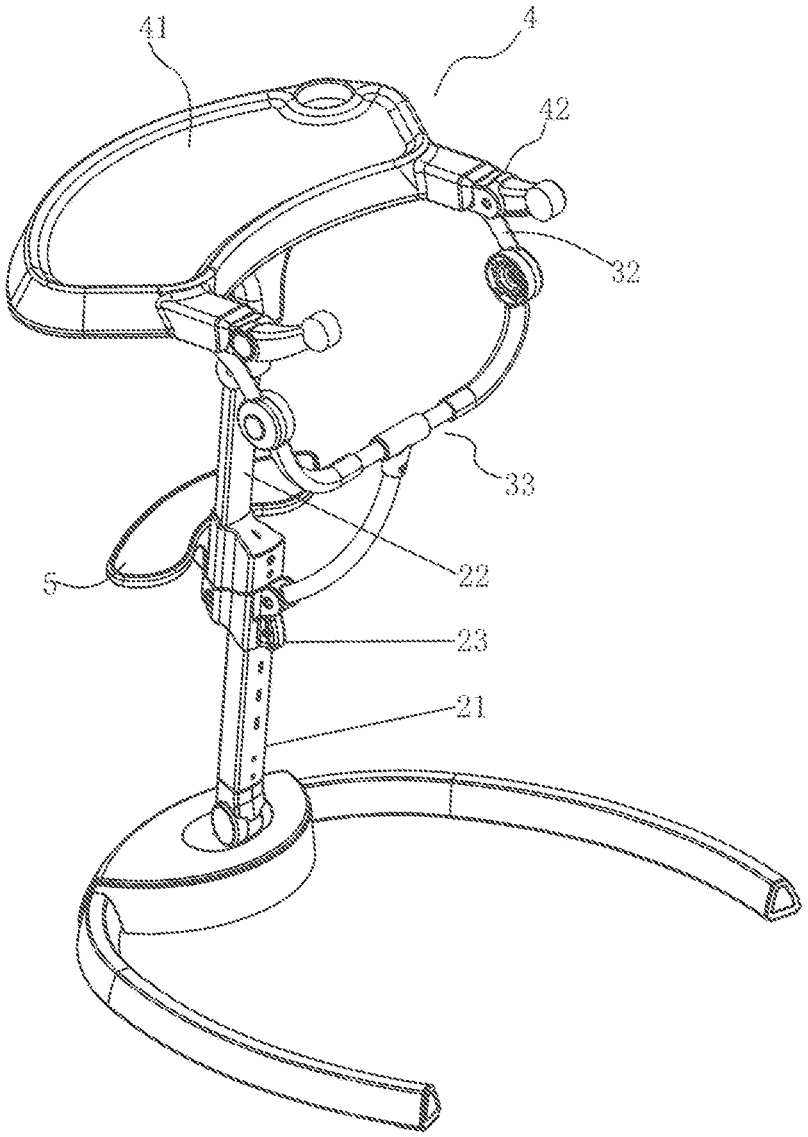
FIG. 3 is a perspective view of the present invention after removing the seat bucket.

As shown in FIG. 3, the base 1 is used to support the entire dining chair, which is roughly in U shape. The U-shaped base 1 is not only simple in structure, but also can maintain stable contact with the bottom surface, thereby ensuring the stability of the entire dining chair. A supporting table 10 is formed at the center of the base 1, and is used to connect with the supporting leg 2.

The present invention is different from the existing similar products. The supporting foot 2 adopts an independent structure, that is, through only one supporting leg 2 to support the seat 3 in the present invention. For the purpose of ensuring the stability of the seat 3, the center of gravity of the loading falls into the central area of the base 1, and the supporting leg 2 is tilted from the bottom up.

In order to achieve height adjustment, the supporting leg 2 of this case employs a telescopic link structure. As shown in FIG. 1 to FIG. 3, the supporting leg 2 comprises a lower supporting leg 21 connected to the supporting base of the base 1, an upper supporting leg 22 connected to the seat 3, and a limiting stopper 23. The lower supporting leg 21 and the upper supporting leg 22 are slidably sleeved with each other, and the two supporting legs can be positioned at a specific height through the limiting stopper 23. In addition, the pedal 5 is mounted on the upper supporting leg 22, and moves up and down along with the upper supporting leg 22.

In addition, in order to facilitate the folding of the entire dining chair, a pivoting structure is adopted between the supporting leg 2 and the base 1, and the angle positioning is realized through a stopper.

Figure 4:
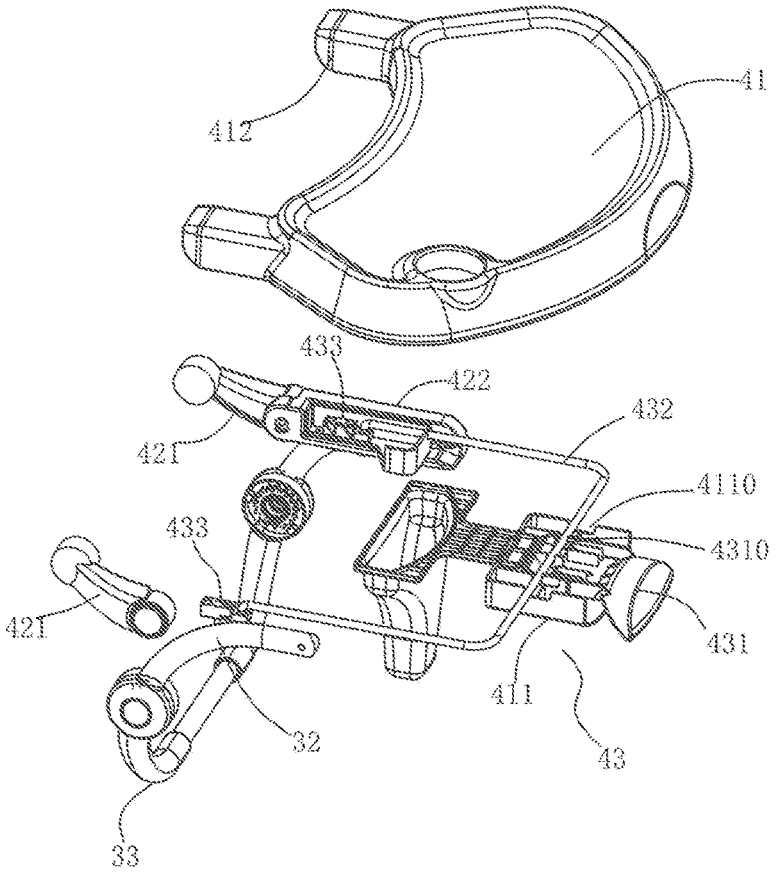
FIG. 4 is an exploded view of the dining table portion of the present invention.
Figure 5:
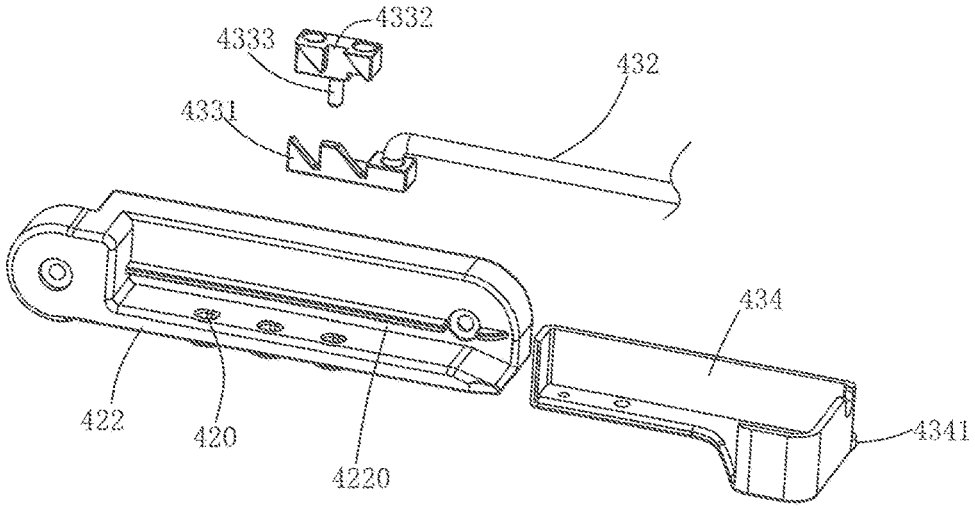
FIG. 5 is a perspective view of the table top of the present invention.
Figure 6:
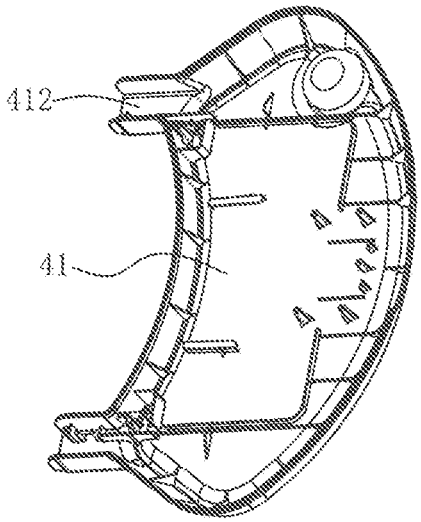
FIG. 6 is a perspective view of the seat portion of the present invention.

As shown in FIG. 4 to FIG. 6, the dining table 4 comprises a table top 41, two table connecting arms 42, and a table moving and controlling assembly 43, wherein one end of the table connecting arms 42 is pivotally connected to the side of the seat 3, and the other end forms a sleeve engagement with the table top 41. The table moving and controlling assembly 43 is configured between the table connecting arm 42 and the table top 41. The table connecting arms 42 and the table top 41 are locked through the table moving and controlling assembly 43.

Specifically speaking, the table moving and controlling assembly 43 comprises a movement control key 431, a movement linking bar 432, and a movement locking element 433. The movement linking bar 432 is a U-shaped bar, and the middle position of the movement linking bar 432 is engaged and connected with the movement control key 431 located at the front end of the table top 41. Through the movement control key 431, the movement linking bar 432 can be moved horizontally. The two terminals of the movement linking bar 432 are linked with the movement locking element 433. The movement locking element 433 is locked with the table connecting arm 42. By triggering the movement control key 431 to bring the movement linking bar 432 to operate, the movement locking element 433 is driven to unlock the table connecting arm 42.

As shown in FIG. 5, the movement locking element 433 comprises a movement trigger 4331 connected to the end of the movement linking bar 432 and a movement buckle 4332 matched with the movement trigger 4331. The combination surface between the movement trigger 4331 and the movement buckle 4332 has an inclined surface, and the movement buckle 4332 is extended downwardly to form a locking pin 4333 that is used to lock the table connecting arm 42.

Corresponding to said movement buckle 4332, a plurality of locking pin insertion holes 420 are provided at positions corresponding to the locking pin 4333 on the table connecting arm 42. The locking pin 4333 is inserted into the locking pin insertion holes 420 provided on the table connecting arm 42 to achieve the locking of movement locking element 433 with the table connecting arm 42. By triggering the movement control key 431 to bring the movement linking bar 432 to operate, the movement trigger 4331 is driven to move relative to the movement buckle 4332, and the combined inclined surface between said two elements can lift up the movement buckle 4332, making the locking pin 4333 separate from the locking pin insertion holes 420. That is to say, when the movement trigger 4331 moves forward, movement trigger 4331 can lift the movement buckle 4332 upward by the action of the inclined surface. When the movement buckle 4332 is lifted upward, the locking pin 4333 is separated from the locking pin insertion holes 420. In this way, lock between the table top 41 and the table connecting arm 42 is released, so that they can move relative to each other. The user can pull the table top 41 forward a certain distance until the locking pin 4333 falls into the next locking pin insertion holes 420.

In addition, the table moving and controlling assembly 43 is arranged at the bottom of the table top 41, where a mounting box 411 is installed. Said movement control key 431 is inserted into the mounting box 411, and the movement linking bar 432 penetrates through the mounting box 411 and inserts into movement control key 431 in the mounting box 411. Specifically speaking, the mounting box 411 is provided with a movement sliding slot 4110 for the penetration of the movement linking bar 432, and an engaging slot 4310 is formed on the movement control key 431 for the engagement and connection with the movement linking bar 432.

As shown in FIG. 4 and FIG. 6, the table connecting arm 42 comprises a table connecting upper arm 421 and a table connecting lower arm 422 pivotally connected with each other, and a sliding sleeve 412 is formed on the table top 41 at the position corresponding to the table connecting arm 42. The end of the table connecting upper arm 421 is pivotally connected to the side of the seat 3, and the end of the table connecting lower arm 422 is inserted into the sliding sleeve 412 on the table top 41.

Figure 9:
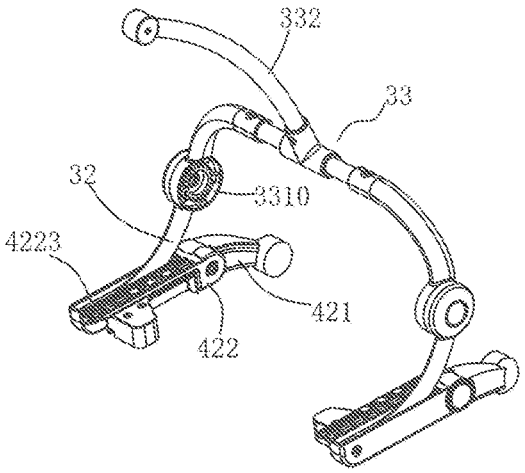
FIG. 9 is another perspective view of FIG. 8 from different angle.
Figure 10:
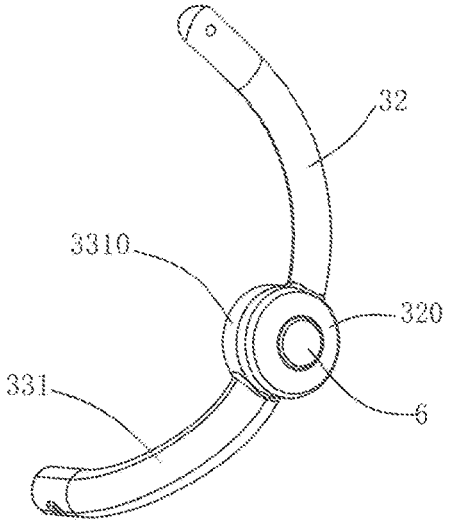
FIG. 10 is a perspective view of the joint portion of the seat bucket upper support member with the armrest of the present invention.
Figure 11:
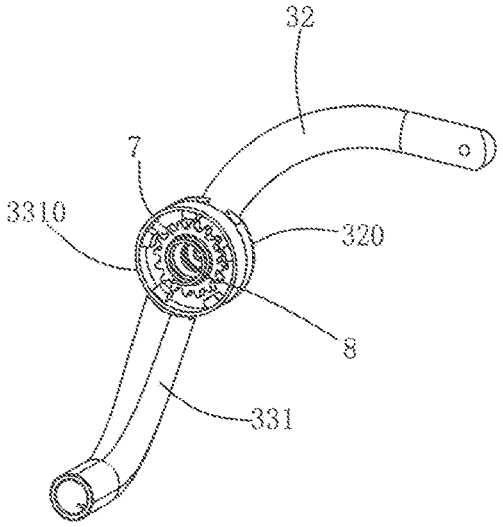
FIG. 11 is another perspective view of FIG. 10 from different angle.
Figure 12:
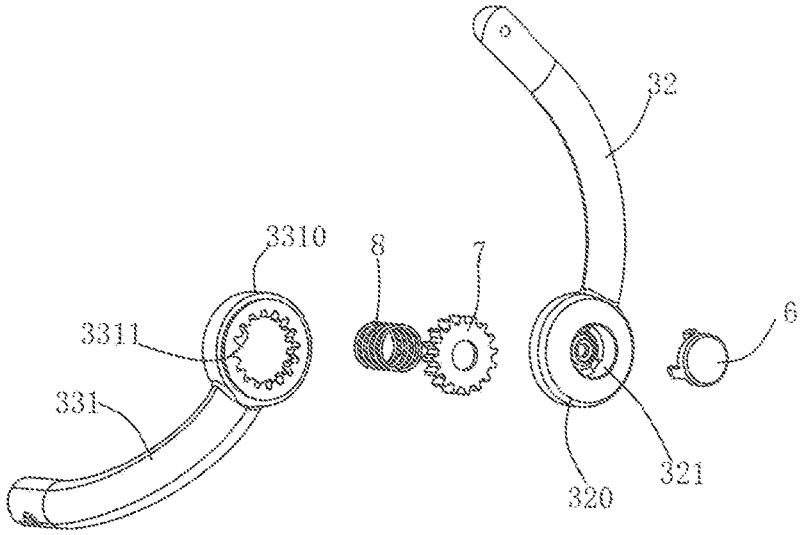
FIG. 12 is an exploded view of FIG. 10.
Figure 13:
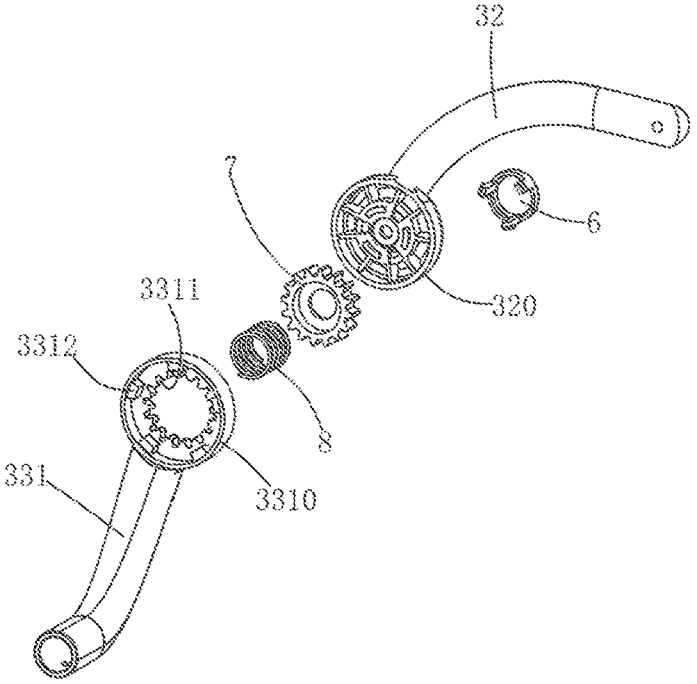
FIG. 13 is an exploded view of FIG. 11.

As shown in FIG. 9, an armrest receiving slot 4223 is formed at the lower end of the table connecting arm 42.

As shown in FIG. 5, in order to ensure the stability of the movement trigger 4331 during the movement, the movement trigger 4331 is fixed on a movement seat 434. A recess is formed on the inner side of the table connecting lower arm 422 and corresponding to the movement seat 434. A guide bar 4341 is formed on the outer side of the movement seat 434, and the side wall of the recess of the table connecting lower arm 422 forms a sliding groove 4220 which matches with the guide bar 4341. In this way, the movement trigger 4331 during the movement will be guided along the guide of the guide bar 4341 and the sliding groove 4220, and no jump will take place.

Figure 7:
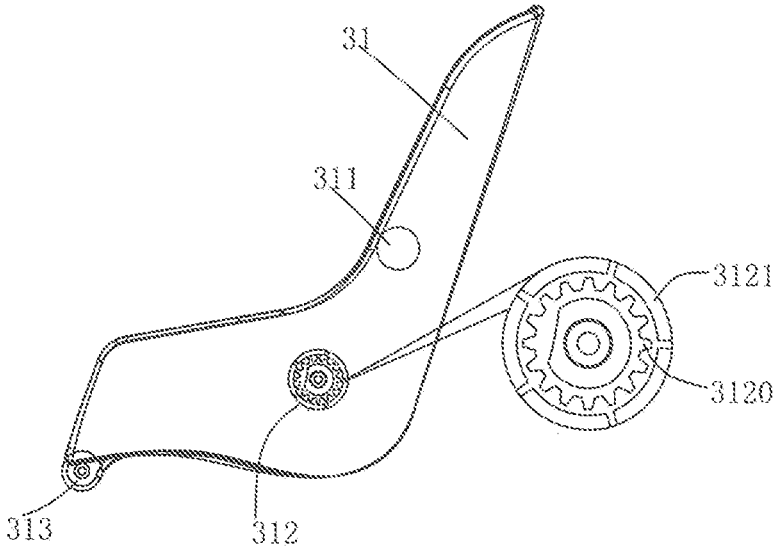
FIG. 7 is a right side view of the seat bucket of the present invention.
Figure 8:
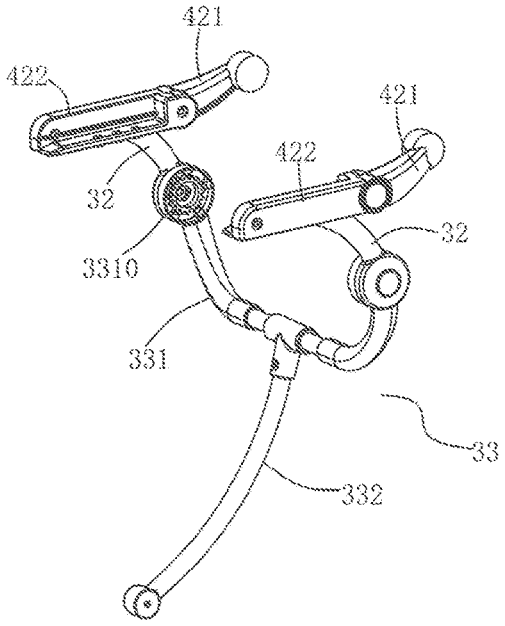
FIG. 8 is a perspective view of the armrest and the seat bucket support mechanism of the present invention.

As shown in FIG. 7 to FIG. 9, the seat 3 comprises a seat bucket 31 for the baby to sit, armrests 32 that are rotationally disposed on both sides of the seat bucket 31, and a seat bucket support mechanism 33 located below the seat bucket 31. The front end of the armrest 32 is fallen into the armrest receiving slot 4223 in order to form a horizontal support for the table connecting arm 42.

The seat bucket 31 is integrally formed, both sides of which are provided with a first pivotal portion 311 and a second pivotal portion 312. A third pivotal portion 313 is provided at the bottom near the front end. The first pivotal portion 311 is used for pivoting with the end portion of the table connecting upper arm 421. The second pivotal portion 312 is used to connect with the armrest 32. The third pivotal portion 313 is used for pivoting with the top end of the upper supporting leg 22.

The seat bucket support mechanism 33 comprises a seat bucket upper support member 331 and a seat bucket lower support member 332. The main body of the seat bucket upper support member 331 is in a U shape. The two ends of the seat bucket upper support member 331 are connected to the combining position of the armrest 32 with the seat bucket 31, namely, connecting to the position of second pivotal portion 312. The upper end of the seat bucket lower support member 332 is connected to the middle position of the bottom of the seat bucket upper support member 331, and the lower end is pivotally connected with the supporting leg 2.

In order to realize the adjustment of the angle of the seat bucket 31, a rotation brake mechanism is set in the present case. The rotation brake mechanism comprises a seat bucket spline 3120 formed in the second pivotal portion 312, a key cap 6 provided on the armrest pivotal portion 320, a brake gear 7 located between the support member pivotal portion 3310 and the armrest pivotal portion 320, and a spring 8 located between the brake gear 7 and the support member pivotal portion 3310. Specifically speaking, as shown in FIGS. 6, and 10-12, the second pivotal portion 312 of the seat bucket 31 is formed with a seat bucket spline 3120. The armrest 32 is formed with an armrest pivotal portion 320 at the place corresponding to the second pivotal portion 312. An armrest recess 321 is formed on the outside of the armrest pivotal portion 320. A key cap 6 is embedded into the armrest recess 321, and has a certain pressing space.

The seat bucket upper support member 331 is formed with a support member pivotal portion 3310 at the place corresponding to the second pivotal portion 312. The support member pivotal portion 3310 is located inside armrest pivotal portion 320, and a brake gear 7 is pivotally connected between the support member pivotal portion 3310 and the armrest pivotal portion 320. A spring 8 is set between the brake gear 7 and the support member pivotal portion 3310, and an outward elastic force is generated through the spring 8 to the brake gear 7 and the key cap 6. A support spline 3311 is formed on the inner wall of the support member pivotal portion 3310, and the brake gear 7 falls into both the support spline 3311 and the seat bucket spline 3120. Due to the presence of the brake gear 7, there is no relative rotation between the support member pivotal portion 3310 and the seat bucket 31. When the angle of the seat bucket 31 needs to be adjusted, the key cap 6 is pressed down first, and the key cap 6 is pressed against the elastic force of the spring 8 to push the brake gear 7 to move toward the seat bucket 31, thereby pushing the brake gear 7 completely into the second pivotal portion 312. At this time, the brake gear 7 completely falls into the seat bucket spline 3120, and no longer interferes with the support spline 3311. As a result, brake disappears between the second pivotal portion 312 of the seat bucket 31 and the support member pivotal portion 3310. So, relative rotation and the angle adjustment of the seat bucket 31 can be achieved.

In order to limit the angle adjustment of the seat bucket 31 within a certain range, a limiting structure is provided between the second pivotal portion 312 and the support member pivotal portion 3310. Specifically, in the second pivotal portion 312, a limiting groove 3121 is set on the outer periphery of the seat bucket spline 3120, and a limiting protrusion 3312 is provided inside the support member pivotal portion 3310 at a position corresponding to the limiting groove 3121. The rotation angle of the seat bucket 31 is limited by the rotation angle of the limiting groove 3121 and the limiting protrusion 3312.

In said description, the angle adjustment of the seat 3 and the horizontal movement of the dining table 4 both do not possess an associated adjustment structure, which may lead to the following problems: when the user adjusts the angle of the seat 3, the dining table 4 is not adjusted with the rotation of the seat 3, which causes the dining table 4 to no longer remain horizontal and to tilt at a certain angle. If, in this time, items such as food are placed on the top of the dining table 4, overturning may occur. Therefore, the inventor adopts the following design for this problem.

Figure 14:
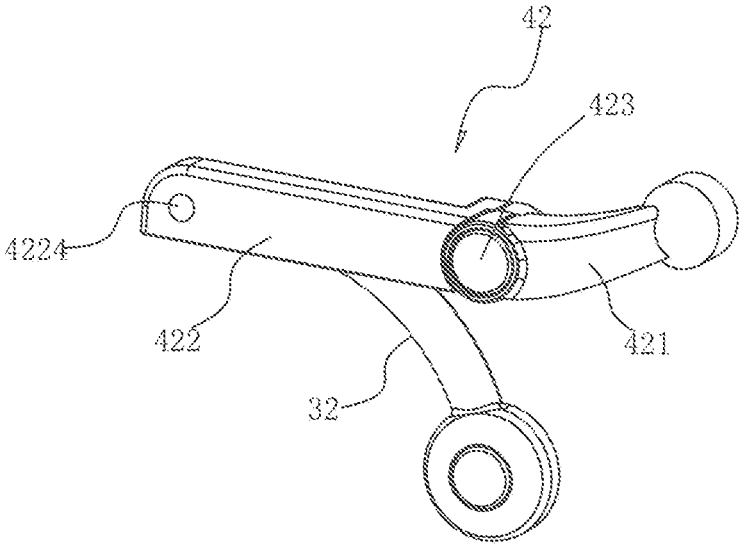
FIG. 14 is a perspective view of the table connecting arm and armrest of the present invention.
Figure 15:
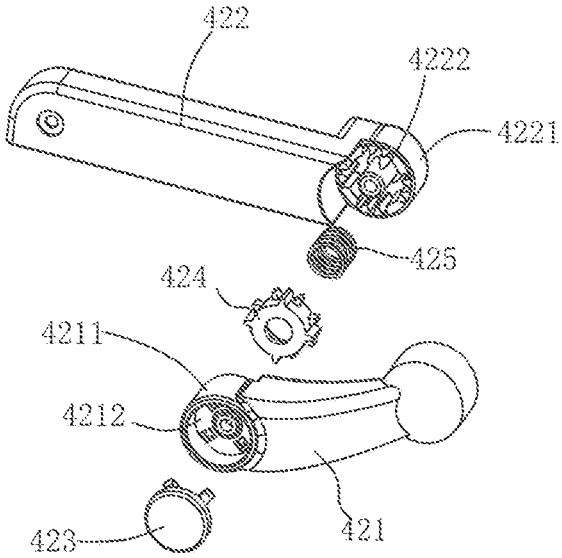
FIG. 15 is an exploded view of the table connecting arm of the present invention.
Figure 16:
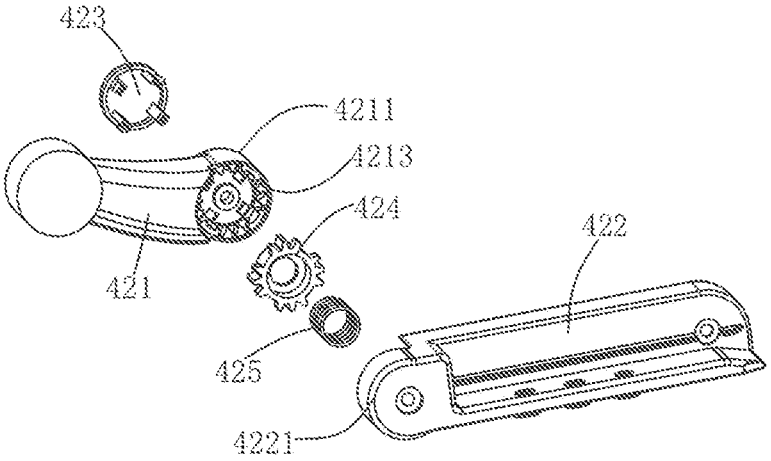
FIG. 16 is an exploded view of the table connecting arm of the present invention from another perspective.
Figure 17:
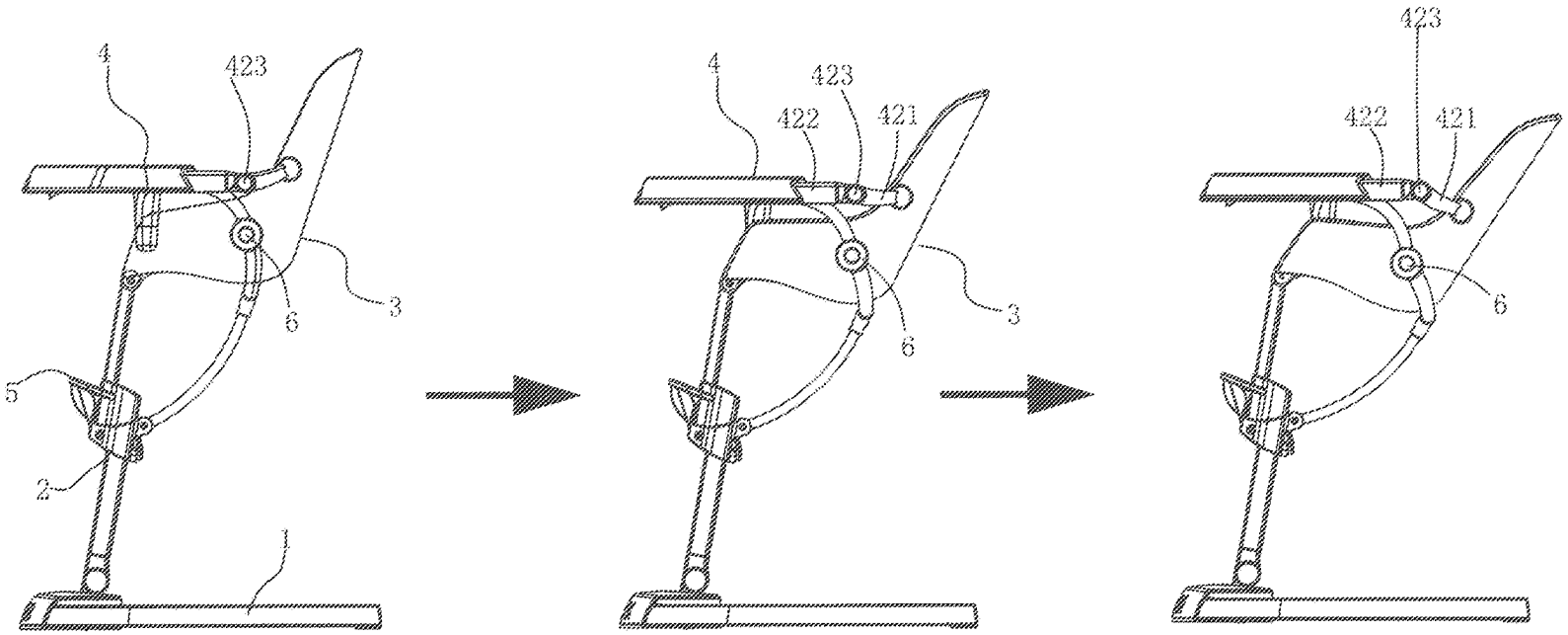
FIG. 17 is a schematic diagram of the seat angle adjustment of the present invention when in use.

As shown in FIG. 14 to FIG. 16, in combination with said description, the table connecting arm 42 comprises a table connecting upper arm 421 and a table connecting lower arm 422 pivotally connected with each other. A connecting arm rotation and control mechanism is set at the pivotal portion of the table connecting upper arm 421 and the table connecting lower arm 422. The connecting arm rotation and control mechanism adopts the following design:

The table connecting upper arm 421 has an upper arm pivotal portion 4211, and the table connecting lower arm 422 has a lower arm pivotal portion 4221. An upper arm groove 4212 is formed on the outside of the upper arm pivot portion 4211, and an upper arm spline 4213 is formed on the inside of the upper arm pivotal portion 4211 at a place corresponding to the upper arm groove 4212. The table connecting lower arm 422 has a lower arm pivotal portion 4221, and a lower arm spline 4222 is set outside the lower arm pivotal portion 4221. The table connecting upper arm 421 and the table connecting lower arm 422 are pivotally connected to each other through the upper arm pivotal portion 4211 and the lower arm pivotal portion 4221.

A connecting arm control button 423 is embedded in the upper arm groove 4212, and the connecting arm control button 423 has a certain pressing space. A connecting arm brake gear 424 and a connecting arm spring 425 are sequentially set at the upper arm pivotal portion 4211 and the lower arm pivotal portion 4221. The connecting arm spring 425 at the connecting arm brake gear 424 and the lower arm pivotal portion 4221 will produce an outward elastic force to the connecting arm brake gear 424. Under the action of this elastic force, the connecting arm brake gear 424 will fall into the upper arm spline 4213 and the lower arm spline 4222 at the same time. Due to the presence of the connecting arm brake gear 424, the upper arm pivotal portion 4211 and the lower arm pivotal portion 4221 cannot achieve relative rotation. When it is necessary to adjust the angle between the table connecting upper arm 421 and the table connecting lower arm 422, it suffices to press the connecting arm control button 423. In this way, the connecting arm control button 423 overcomes the elastic force of the connecting arm spring 425 and pushes the connecting arm brake gear 424 to move toward the lower arm pivotal portion 4221 to fully push the connecting arm brake gear 424 into the lower arm spline 4222, so that the connecting arm brake gear 424 no longer interferes with the upper arm spline 4213, and the table connecting upper arm 421 and the table connecting lower arm 422 can be rotated with relative to each other.

As described above, the lower end of the table connecting lower arm 422 is formed with an armrest receiving slot 4223. The front end of the armrest 32 is fallen into the armrest receiving slot 4223 in order to form horizontal support for the table connecting arm 42. The end of the armrest 32 is pivotally connected to the armrest receiving slot 4223 with a pin 4224, thereby forming a linkage between the table connecting arm 42 and the armrest 32.

Through said-mentioned structure, the angle adjustment of the seat 3 and the horizontal movement of the dining table 4 can form a linkage in the present case.

When it is necessary to adjust the angle of the seat bucket 31, the key cap 6 and the connecting arm control button 423 are simultaneously pressed down. In adjusting the angle of the seat bucket 31, because the armrest 32 is pivotally connected to the seat bucket 31 and the table connecting arm 42 and at the same time the connecting arm control button 423 has been pressed, the table connecting upper arm 421 and the table connecting lower arms 422 can rotate freely with each other. As the angle of the seat bucket 31 is adjusted, the angle between the table connecting upper arm 421 and the table connecting lower arm 422 in the table connecting arm 42 is also adjusted at the same time, making the table connecting lower arm always be kept in a horizontal state, that is, the table top 41 of the dining table 4 remains kept in the horizontal direction, thus ensuring that the dining table 4 does not tilt at a certain angle. When the angle of the seat bucket 31 is adjusted, the key cap 6 and the connecting arm control button 423 are simultaneously released, making the seat 3 and the dining table 4 be kept in the current position and waiting for the next adjustment.

I claim:

1. A baby dining chair comprising:

a base (1), a supporting leg (2), a seat (3) and a dining table (4), wherein the supporting leg (2) is installed between the base (1) and the seat (3); the dining table (4) is pivotally connected to the seat (3);

wherein the seat (3) includes a seat bucket (31) for a baby to sit, armrests (32) disposed on both sides of the seat bucket (31), and a seat bucket support mechanism (33) located below the seat bucket (31); first pivoting portions (311) and second pivoting portions (312) are set on both sides of the seat bucket (31), respectively;

wherein the dining table (4) includes a table top (41) and a table connecting arm (42); the table connecting arm (42) includes a table connecting upper arm (421) and a table connecting lower arm (422) pivotally connected with each other; a connecting arm rotation and control mechanism is set at a pivoting portion of the table connecting upper arm (421) and the table connecting lower arm (422);

one end of the table connecting upper arm (421) is pivotally connected to the first pivoting portions (311); a lower end of the armrest (32) and an upper end of the seat bucket support mechanism (33) are both pivotally connected to the second pivoting portions (312); an upper end of the armrest (32) is pivotally connected to one end of the table connecting lower arm (422);

wherein the second pivoting portions (312) is further provided with a rotation brake mechanism, through which the seat bucket (31) rotates around the second pivoting portions (312).

2. The baby dining chair defined in claim 1, wherein the armrest (32) is formed with an armrest pivotal portion (320) at a place corresponding to the second pivoting portion (312), and the seat bucket support (33) is formed with a support pivotal portion (3310) at a place corresponding to the second pivoting portion (312);

the rotation brake mechanism comprises a seat bucket spline (3120) formed in the second pivoting portion (312), a key cap (6) set on the armrest pivotal portion (320), a brake gear (7) located between the support member pivotal portion (3310) and the armrest pivotal portion (320), a spring (8) located between the brake gear (7) and the support member pivotal portion (3310);

a support spline (3311) is formed on the inner wall of the support member pivotal portion (3310) to mesh with the brake gear (7), and the brake gear (7) falls into both the support spline (3311) and the seat bucket spline (3120); through pressing the key cap (6), a force is generated to overcome the spring (8) pressure to push the brake gear (7) to move inward, making the brake gear (7) fall into the seat bucket spline (3120) and no longer interfering with the support spline (3311), thus fulfilling an unlock of the rotation brake mechanism.

3. The baby dining chair defined in claim 1, wherein the table connecting upper arm (421) has a upper arm pivotal portion (4211), and the table connecting lower arm (422) has a lower arm pivotal portion (4221);

the connecting arm rotation and control mechanism comprises an upper arm spline (4213) formed on the inside of the upper arm pivotal portion (4211), a connecting arm control button (423) set on the outside of the upper arm pivotal portion (4211), a connecting arm brake gear (424) and a connecting arm spring (425) located between the upper arm pivotal portion (4211) and the lower arm pivotal portion (4221), and a lower arm spline (4222) set on the outside of the lower arm pivotal portion (4221);

under the action of the connecting arm spring (425), the connecting arm brake gear (424) will fall into the upper arm spline (4213) and the lower arm spline (4222) at the same time; by pressing the connecting arm control button (423) to overcome the spring force generated by the connecting arm spring (425), the connecting arm brake gear (424) is pushed to fall into the lower arm spline (4222) to achieve an unlock of the connecting arm rotation and control mechanism.

4. The baby dining chair defined in claim 3, wherein the seat bucket support mechanism (33) comprises a seat bucket upper support member (331) and a seat bucket lower support member (332); the main body of the seat bucket upper support member (331) is in a U shape; the two ends of the seat bucket upper support member (331) are connected to the second pivoting portion (312); the upper end of the seat bucket lower support member (332) is connected to the middle position of the bottom of the seat bucket upper support member (331), and the lower end of the seat bucket lower support member (332) is pivotally connected with the supporting leg (2).

5. The baby dining chair defined in claim 3, wherein a lower end of the table connecting lower arm (422) is formed with an armrest receiving slot (4223); a front end of the armrest (32) is fallen into an armrest receiving slot (4223); an end of the armrest (32) is pivotally connected to the armrest receiving slot (4223) with a pin (4224).

6. The baby dining chair defined in claim 3, wherein the dining table (4) comprises a table moving and controlling assembly (43), wherein one end of the table connecting arms (42) is pivotally connected to the first pivoting portion (311) at the side of the seat (3), and the other end forms a sleeve engagement with the table top (41); the table moving and controlling assembly (43) is configured between the table connecting arm (42) and the table top (41); through the table moving and controlling assembly (43), table connecting arms (42) and table top (41) are locked.

7. The baby dining chair defined in claim 6, wherein the table moving and controlling assembly (43) comprises a movement control key (431), a movement linking bar (432), and a movement locking element (433); the movement linking bar (432) is a U-shaped bar; the front end of the movement linking bar (432) is linked with the movement control key (431), and two terminals are linked with the movement locking element (433); the movement locking element 433 is locked with the table connecting arm (42); by triggering the movement control key (431), movement linking bar (432) is driven to drive the movement locking element (433) to unlock the table connecting arm (42).

8. The baby dining chair defined in claim 7, wherein the movement locking element (433) comprises a movement trigger (4331) connected to the end of the movement linking bar (432) and a movement buckle (4332) matched with the movement trigger (4331); the combination surface between the movement trigger (4331) and the movement buckle (4332) has an inclined surface, and the movement buckle (4332) is extended downwardly to form a locking pin (4333) that is used to lock the table connecting arm (42).

9. The baby dining chair defined in claim 8, wherein a plurality of locking pin insertion holes (420) are provided at positions corresponding to the locking pin (4333) on the table connecting arm (42); the locking pin (4333) is inserted into the locking pin insertion holes (420) provided on the table connecting arm (42) to achieve the locking of movement locking element (433) with the table connecting arm (42); by triggering the movement control key (431) to bring the movement linking bar (432) to drive the movement trigger (4331) and the movement buckle (4332) to move relative to each other, the combined inclined surface between said two elements can lift up the movement buckle (4332), making the locking pin (4333) separate from the locking pin insertion holes (420).

10. The baby dining chair defined in claim 1, wherein the supporting leg (2) adopts an independent, tilt-setting telescopic link structure, and the upper end of the supporting leg (2) is pivotally connected to the third pivotal portion (313) of the seat bucket (31) and the lower end is connected to the base (1).

* * * * *